US009799322B2

(12) United States Patent
Eaton et al.

(10) Patent No.: US 9,799,322 B2
(45) Date of Patent: Oct. 24, 2017

(54) REVERBERATION ESTIMATOR

(71) Applicant: GOOGLE INC., Mountain View, CA (US)

(72) Inventors: D. James Eaton, London (GB); Alastair H. Moore, Ruislip (GB); Patrick A. Naylor, Reading (GB); Jan Skoglund, Mountain View, CA (US)

(73) Assignee: Google Inc., Mountain View, CA (US)

( * ) Notice: Subject to any disclaimer, the term of this patent is extended or adjusted under 35 U.S.C. 154(b) by 190 days.

(21) Appl. No.: 14/521,104

(22) Filed: Oct. 22, 2014

(65) Prior Publication Data

US 2016/0118038 A1 Apr. 28, 2016

(51) Int. Cl.

| | |
|---|---|
| ***G10K 15/08*** | (2006.01) |
| ***H04R 3/00*** | (2006.01) |
| ***G10L 21/0208*** | (2013.01) |
| ***G10L 25/03*** | (2013.01) |
| *G10L 21/0216* | (2013.01) |
| *G10L 25/18* | (2013.01) |
| *G10L 25/21* | (2013.01) |

(52) U.S. Cl.

CPC ..... *G10K 15/08* (2013.01); *G10L 21/0208* (2013.01); *G10L 25/03* (2013.01); *H04R 3/005* (2013.01); *G10L 25/18* (2013.01); *G10L 25/21* (2013.01); *G10L 2021/02082* (2013.01); *G10L 2021/02166* (2013.01)

(58) Field of Classification Search

CPC ..... G10K 15/08; G10L 21/0208; G10L 25/03; G10L 25/18; G10L 25/21; G10L 2021/02082; G10L 2021/02166; H04R 3/005

USPC ..... 381/63, 92, 66

See application file for complete search history.

(56) References Cited

FOREIGN PATENT DOCUMENTS

JP 2013-178110 A 9/2013

OTHER PUBLICATIONS

Hioka et al., "Estimating Direct-to-Reverberant Energy Ratio Using D/R Spatial Correlation Matrix Model," IEEE Transactions on Audio, Speech, and Language Processing 19:8:2374-2384 (Nov. 2011).

ISR & Written Opinion, dated Jan. 22, 2016, in related application No. PCT/US2015/056674.

Baldwin Dumortier and Emmanuel Vincent, "Blind RT60 Estimation Robust Across Room Sizes and Source Distances," 2014 IEEE International Conference on Acoustics, Speech, and Signal Processing (ICASSP), May 2014, Firenze, Italy.

(Continued)

*Primary Examiner* — Vivian Chin
*Assistant Examiner* — Douglas Suthers
(74) *Attorney, Agent, or Firm* — Brake Hughes Bellermann LLP

(57) ABSTRACT

Provided are methods and systems for generating Direct-to-Reverberant Ratio (DRR) estimates. The methods and systems use a null-steered beamformer to produce accurate DRR estimates across a variety of room sizes, reverberation times, and source-receiver distances. The DRR estimation algorithm uses spatial selectivity to separate direct and reverberant energy and account for noise separately. The formulation considers the response of the beamformer to reverberant sound and the effect of noise. The DRR estimation algorithm is more robust to background noise than existing approaches, and is applicable where a signal is recorded with two or more microphones, such as with mobile communications devices, laptop computers, and the like.

8 Claims, 8 Drawing Sheets

(56) References Cited

OTHER PUBLICATIONS

J. B. Allen and D. A. Berkley, "Image method for efficiently simulating small-room acoustics," J. Acoust. Soc. Am., vol. 65, No. 4, pp. 943-950, Apr. 1979.

M. Jeub, C.M. Nelke, C. Beaugeant, and P. Vary, "Blind estimation of the coherent-to-diffuse energy radio from noisy speech signals," in Proc. European Signal Processing Conf. (EUSIPCO), Barcelona, Spain, 2011.

REVERBERATION ESTIMATOR

BACKGROUND

When capturing audio (e.g., speech) in rooms with one or multiple microphones, the captured signal is modified by sound reflections in the room (often referred to as "reverberation") in addition to environmental noise sources. Typically this modification is handled through speech enhancement signal processing techniques.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to producing Direct-to-Reverberant Ratio (DRR) estimates using a null-steered beamformer.

One embodiment of the present disclosure relates to a computer-implemented method comprising: separating an audio signal into a direct path signal component and a reverberant path signal component using a beamformer; determining, for each of a plurality of frequency bins, a ratio of the power of the direct path signal component to the power of the reverberant path signal component; and combining the determined ratios over a range of the frequency bins.

In another embodiment, separating the audio signal into the direct path signal component and the reverberant path signal component includes removing the direct path signal component by placing a null at a direction of the direct path signal component.

In another embodiment, placing the null at the direction of the direct path signal component includes selecting weights for the beamformer to steer the null towards a direction of arrival of the direct path signal component.

In another embodiment, the method further comprises compensating for estimated noise received at the beamformer.

Another embodiment of the present disclosure relates to a computer-implemented method comprising: removing a direct path signal component of an audio signal by placing a beamformer null at a direction of the direct path signal component, thereby separating the direct path signal component from a reverberant path signal component of the audio signal; determining, for each of a plurality of frequency bins, a ratio of the power of the direct path signal component to the power of the reverberant path signal component; and combining the determined ratios over a range of the frequency bins.

Yet another embodiment of the present disclosure relates to a system comprising a least one processor and a non-transitory computer-readable medium coupled to the at least one processor having instructions stored thereon that, when executed by the at least one processor, causes the at least one processor to: separate an audio signal into a direct path signal component and a reverberant path signal component using a beamformer; determine, for each of a plurality of frequency bins, a ratio of the power of the direct path signal component to the power of the reverberant path signal component; and combine the determined ratios over a range of the frequency bins.

In another embodiment, the at least one processor of the system is further caused to remove the direct path signal component by placing a null at a direction of the direct path signal component.

In yet another embodiment, the at least one processor of the system is further caused to select weights for the beamformer to steer the null towards a direction of arrival of the direct path signal component.

In another embodiment, the at least one processor of the system is further caused to compensate for estimated noise received at the beamformer.

Still another embodiment of the present disclosure relates to a system comprising a least one processor and a non-transitory computer-readable medium coupled to the at least one processor having instructions stored thereon that, when executed by the at least one processor, causes the at least one processor to: remove a direct path signal component of an audio signal by placing a beamformer null at a direction of the direct path signal component, thereby separating the direct path signal component from a reverberant path signal component of the audio signal; determine, for each of a plurality of frequency bins, a ratio of the power of the direct path signal component to the power of the reverberant path signal component; and combine the determined ratios over a range of the frequency bins.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
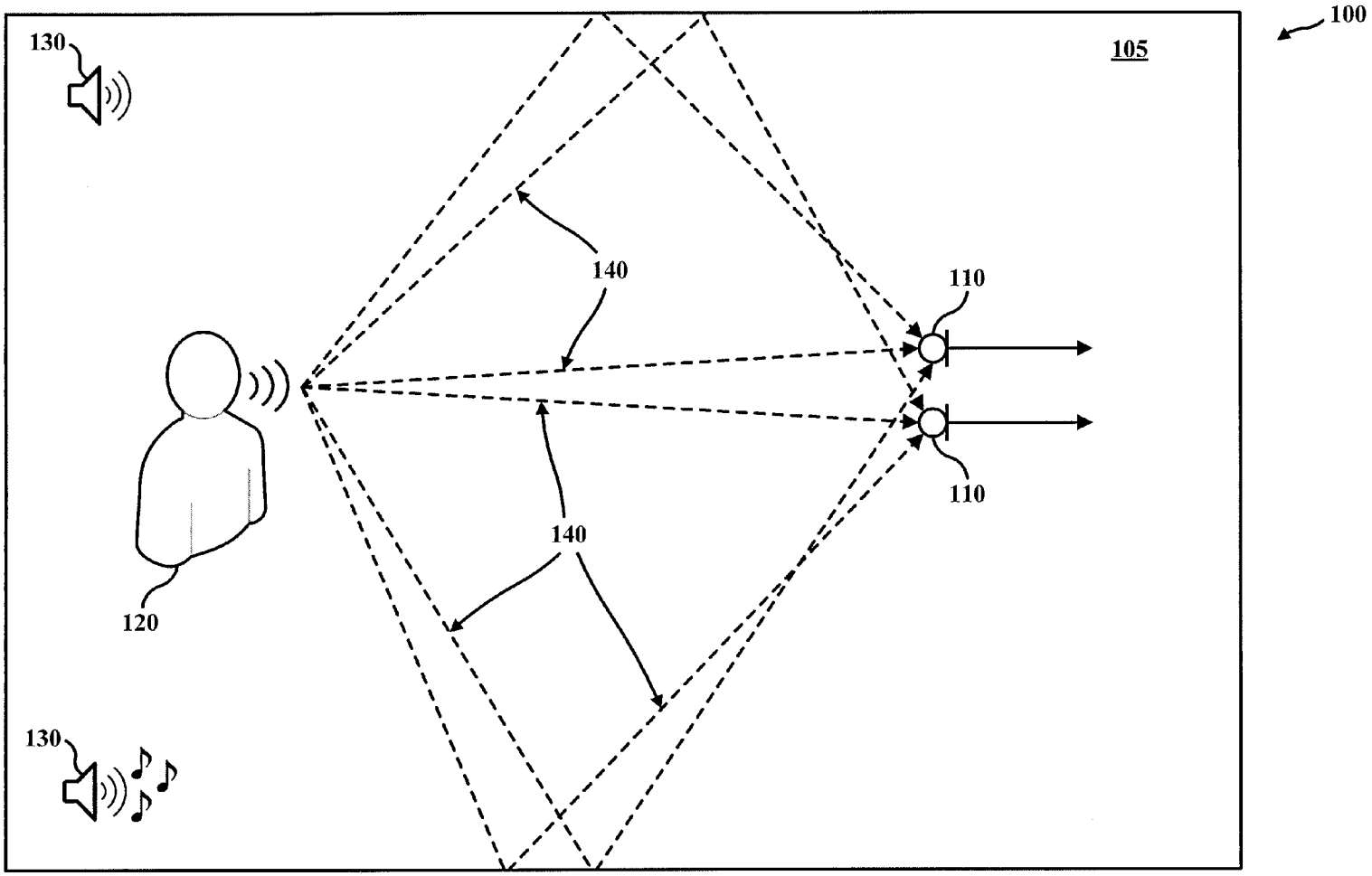
FIG. 1 is a schematic diagram illustrating an example application for a DRR estimation algorithm according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Overview

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

Determining the acoustic characteristics of an environment is important for speech enhancement and recognition. The modification of an audio signal (e.g., a signal containing speech) by reverberation and environmental noise if often handled through speech enhancement signal processing techniques. Since the performance of speech enhancement algorithms can be improved if the level of reverberation relative to the speech is known, the present disclosure provides methods and systems for estimating this relation.

Reverberation affects the quality and intelligibility of distant speech recorded in a room. Direct-to-Reverberant Ratio (DRR), which is a ratio between the energies (e.g., intensities) of direct sound (e.g., speech) and reverberation, is a useful measure for assessing the acoustic configuration and can be used to inform de-reverberation algorithms. As will be described in greater detail herein, embodiments of the present disclosure relate to a DRR estimation algorithm applicable where a signal is recorded with two or more microphones, such as mobile communications devices, laptop computers, and the like.

In accordance with one or more embodiments described herein, the methods and systems of the present disclosure use a null-steered beamformer to produce accurate DRR estimates to within ±4 dB across a wide variety of room sizes, reverberation times, and source-receiver distances. In addition, the methods and systems presented are more robust to background noise than existing approaches. As will be described in further detail below, in at least one hypothetical scenario the most accurate DRR estimation may be obtained in the region from −5 to 5 dB, which is a relevant range for portable devices.

When the Acoustic Impulse Response (AIR) is available, the DRR can be estimated from the impulse response by examining the onset and decay characteristics of the AIR. However, when the AIR is not available the DRR must be estimated from the recorded speech. Portable communications devices such as, for example, laptops, smartphones, etc., are increasingly incorporating multiple microphones enabling the use of multichannel algorithms.

Some existing approaches to non-intrusive DRR estimation use the spatial coherence between channels to estimate the reverberation, which assumes that all non-coherent energy is reverberation. Other existing approaches use modulation spectrum features, which require a mapping that is trained on speech.

In view of various deficiencies associated with existing approaches, the methods and systems of the present disclosure provide a novel DRR estimation approach which uses spatial selectivity to separate direct and reverberant energy and account for noise separately. The formulation considers the response of the beamformer to reverberant sound and the effect of noise.

The methods and systems of the present disclosure have numerous real-world applications. For example, the methods and systems may be implemented in computing devices (e.g., laptop computers, desktop computers, etc.) to improve sound recording, video conferencing, and the like. FIG. 1 illustrates an example 100 of such an application, where an audio source 120 (e.g., a user, speaker, etc.) is positioned in a room 105 with an array of audio capture devices 110 (e.g., a microphone array), and a signal generated from the source 120 may follow multiple paths 140 to the microphone array 110. There may also be one or more background noise sources 130 also present in the room 105. In another example, the methods and systems of the present disclosure may be used in mobile devices (e.g., mobile telephones, smartphones, personal digital assistants (PDAs)) and in various systems designed to control devices by means of speech recognition.

Figure 2:
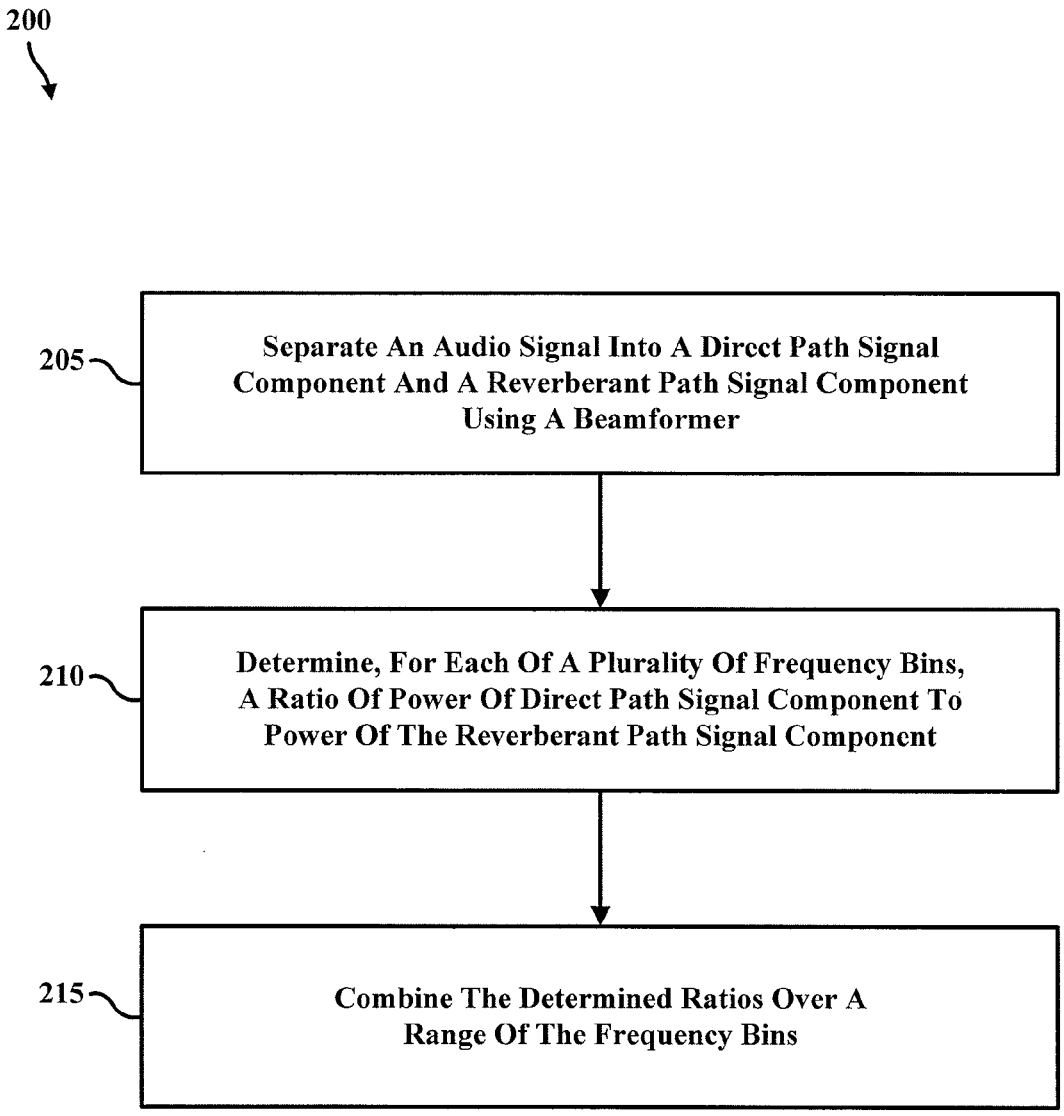
FIG. 2 is flowchart illustrating an example method for generating DRR estimates according to one or more embodiments described herein.

The following provides details about the DRR estimation algorithm of the present disclosure and also describes some example performance results of the algorithm. FIG. 2 illustrates an example high-level process 200 for generating DRR estimates. The details of blocks 205-215 in the example process 200 will be further described in the following.

Acoustic Model

A continuous speech signal, s(t), radiating from a given position in a room will follow multiple paths to any observation point comprising the direct path as well as reflections from the walls, floor, ceiling, and the surfaces of other objects in the room. The reverberant signal, $y_m(t)$, captured by the m-th microphone in an array of M microphones in the room is characterized by the AIR, $h_m$ (t), of the acoustic channel between the source and the microphone such that $$y_m(t)=h_m(t)*s(t)+v_m(t), \tag{1}$$

where * denotes a convolution operation, and $v_m(t)$ is the additive noise at the microphone. The AIR is a function of the geometry of the room, the reflectivity of the surfaces of the room, and the microphone locations. Let $$h_m(t)=h_{d,m}(t)+h_{r,m}(t), \tag{2}$$

where $h_{d,m}(t)$ and $h_{r,m}(t)$ are the impulse responses of the direct and reverberant paths for the m-th microphone, respectively. The DRR at the m-th microphone, $\eta_m$, is the ratio of the power arriving directly at the microphone from the source to the power arriving after being reflected from one or more surfaces in the room. The DRR may be written as $$\overline{\eta}_m = \frac{\int |h_{d,m}(t)|^2 dt}{\int |h_{r,m}(t)|^2 dt}. \tag{3}$$

When the impulse response is convolved with a speech signal, the observation at the m-th microphone is the Signal-to-Reverberation Ratio (SRR), $\gamma$, given by $$\gamma_m = \frac{E\{|(h_{d,m}(t))^T * s(t)|^2\}}{E\{|(h_{r,m}(t))^T * s(t)|^2\}}. \tag{4}$$

The SRR is equal to the DRR in the case when s(t) is spectrally white. The aim of non-intrusive or blind DRR estimation is to estimate $\eta_m$ from the observed signals. In accordance with one or more embodiments of the present disclosure, the methods and systems use spatial selectivity to separate the direct and reverberant components of the sound field.

Beamforming in the Frequency Domain

Spatial filtering or beamforming uses a weighted combination of two or more microphone signals to achieve a particular directivity pattern. The output, $Z(j\omega)$, of a beamformer in the complex frequency domain is given by $$Z(j\omega)=(w(j\omega))^T y(j\omega), \tag{5}$$

where $w(j\omega)=[W_0(j\omega), W_1(j\omega), \ldots, W_{M-1}(j\omega)]^T$ is the vector of complex weights for each microphone, and $y(j\omega)=[Y_0(j\omega), Y_1(j\omega), \ldots, Y_{M-1}(j\omega)]^T$ is the vector of microphone signals.

Let the signal at the m-th microphone due to a unit plane wave incident on the microphone be $x_m(j\omega, \Omega)$, where $\Omega=(\phi, \theta)$ is the Direction-of-Arrival (DoA), and $\theta$ and $\phi$ are the azimuth and elevation, respectively. The beam-pattern of the beamformer is $$D(j\omega,\Omega)=(w(j\omega))^T x(j\omega,\Omega), \tag{6}$$

where $x(j\omega, \Omega)=[X_0(j\omega,\Omega), X_1(j\omega,\Omega), \ldots, X_{M-1}(j\omega,\Omega)]^T$.

For an isotropic (e.g., perfectly diffuse) sound field, the gain of the beamformer, $G(j\omega)$, may be given by $$G(j\omega)=\int_\Omega |D(j\omega,\Omega)| d\Omega \tag{7}$$

Estimation of DRR in the Frequency Domain

The following considers how to use the beamformer to estimate DRR, in accordance with one or more embodiments described herein. From equations (1) and (2), described above, the signal at microphone m in the frequency domain may be defined as $$Y_m(j\omega)=D_m(j\omega)+R_m(j\omega)+V_m(j\omega), \tag{8}$$

where $D_m(j\omega)=H_{m,d}(j\omega)S(j\omega)$, and $R_m(j\omega)=H_{m,r}(j\omega)S(j\omega)$.

From equation (5), $$Z_y(j\omega)=Z_d(j\omega)+Z_r(j\omega)+Z_v(j\omega), \tag{9}$$

where $$Z_d(j\omega)=(w(j\omega))^T d(j\omega),$$

$$Z_r(j\omega)=(w(j\omega))^T r(j\omega),$$

$$Z_v(j\omega)=(w(j\omega))^T v(j\omega),$$

and $$d(j\omega)=[D_0(j\omega),D_1(j\omega), \ldots ,D_{M-1}(j\omega)]^T,$$

and $r(j\omega)$ and $v(j\omega)$ are similarly defined.

Choosing $w(j\omega)$ such that $Z_d(j\omega)=0$, gives $$Z_y(j\omega)\approx Z_r(j\omega)+Z_v(j\omega). \tag{10}$$

Under the simplification that the reverberant sound field is composed of plane waves arriving from all directions with equal probability and magnitude, the gain of the beamformer may be given by $$G(j\omega)=\int_\Omega |D(j\omega,\Omega)| d\Omega. \tag{11}$$

Therefore, the output of the beamformer may be given by $$E\{|Z_r(j\omega)|^2\}=G^2(j\omega)E\{|R(j\omega)|^2\}, \tag{12}$$

where $E\{\cdot\}$ is the expectation operator, and $R(j\omega)$ is the reverberant energy, independent of the microphone. Substituting equation (10) into equation (12) gives $$E\{|R(j\omega)|^2\} \approx \frac{1}{G^2(j\omega)}(E\{|Z_y(j\omega)|^2] - E\{|Z_v(j\omega)|^2\}). \tag{13}$$

Since it may be assumed that the reverberation power is the same at all microphones, from equation (8) the following may be written:

$$E\{|D_m(j\omega)|^2\}=E\{|Y_m(j\omega)|^2\}-E\{|V_m(j\omega)|^2\}-E\{|R(j\omega)|^2\}. \tag{14}$$

The frequency dependent DRR follows from equation (3) as $$\eta_m(j\omega) = \frac{E\{|D_m(j\omega)|^2\}}{E\{|R(j\omega)|^2\}}. \tag{14}$$

Substituting equations (13) and (14) into equation (15) gives:

$$\eta_m(j\omega) \approx \frac{E\{|Y_m(j\omega)|^2\} - E\{|V_m(j\omega)|^2\}}{\frac{1}{G^2(j\omega)}(E\{|Z_y(j\omega)|^2\} - E\{|Z_v(j\omega)|^2\})} - 1. \tag{16}$$

The overall DRR is then given by $$\eta(j\omega) = \frac{1}{\omega_2 - \omega_1}\int_{\omega_1}^{\omega_2} \eta_m(j\omega) d\omega, \tag{17}$$

where $\omega_1 \le \omega \le \omega_2$ is the frequency range of interest.

EXAMPLE

To further illustrate the various features of the robust DRR estimation methods and systems of the present disclosure, the following describes some example results that may be obtained through experimentation. It should be understood that although the following provides example performance results in the context of a two-element microphone array, the scope of the present disclosure is not limited to this particular context or implementation. While the following description illustrates that excellent performance can be achieved with a small number (e.g., two) of microphones, and also that the performance is robust, similar levels of performance may also be achieved using the methods and systems of the present disclosure in various other contexts and/or scenarios, including such contexts/scenarios involving more than two microphones.

In the present example, speech signals are randomly selected from test partitions of an acoustic phonetic continuous speech database. These signals are convolved with AIRs generated using a known source-image method for rooms with dimensions {3 meters (m), 4 m, and 5 m}×6 m×3 m, each with Reverberation Time ($T_{60}$) values from 0.2 to 1 second (s) in 0.1 second intervals. In each room, four locations and rotations of the microphone array are chosen at random from a uniform distribution, and the source positioned perpendicular to the array at distances of 0.05, 0.10, 0.50, 1.0, 2.0, and 3.0 m. No microphone or source is allowed to be less than 0.5 m from any wall.

A two-element microphone array is used with a spacing of 62 millimeters (mm) to simulate the microphones in a typical laptop. Beamformer weights are chosen using a delay and subtract scheme to steer a null towards the DoA of the direct path.

Figure 3:
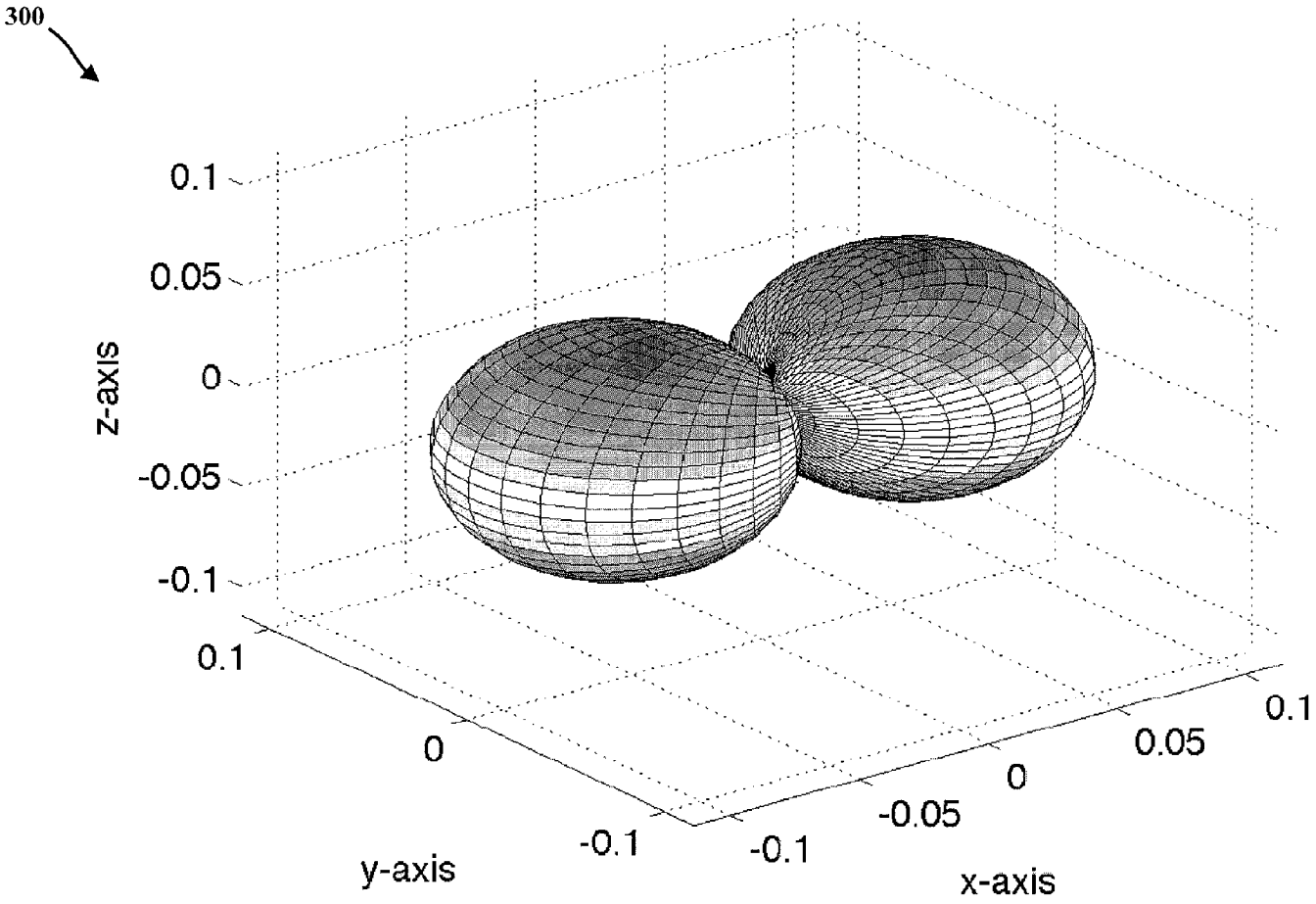
FIG. 3 is a graphical representation illustrating an example dipole beam pattern according to one or more embodiments described herein.

Since all source positions are equidistant from the two microphones, this reduces to a simple subtraction giving the familiar dipole beam pattern shown in FIG. 3. FIG. 3 illustrates a 2-channel null-steered beamformer gain and directivity pattern 300 at 200 Hz with a microphone spacing of 62 mm. It is noted that the maximum gain is −9.4 dB. In practical applications, time difference of arrival estimation using, for example, a generalized correlation method for estimating time delay known to those skilled in the art, is needed to set the delay.

Ground truth DRR is estimated for each room, $T_{60}$, microphone, and source position directly from the simulated AIRs. White Gaussian noise is added independently for each microphone at SNRs of 10, 20, and 30 dB where the clean power is determined using an implementation of an objective measurement of active speech level known to those skilled in the art.

In a first experimental setup, the DRR estimation method of the present disclosure in the case where known values for $E\{|V_m(j\omega)|^2\}$ and $E\{|Z_v(j\omega)|^2\}$ are used is compared with a formulation of the method where noise is ignored (SNR assumed to be 8 dB), and also with a baseline method. In a practical application it may be assumed that a noise estimator robust to reverberation will be used. In order to evaluate the effects of noise estimation errors on the accuracy of the DRR estimator, a second experiment is conducted with ±1.5 dB added to each of $E\{|V_m(j\omega)|^2\}$ and $E\{|Z_v(j\omega)|^2\}$ in equation (16).

In the present example, the baseline method used for comparison returns a vector of estimated DRR by frequency, and the mean of the values>−∞ is used in the comparison.

Figure 4:
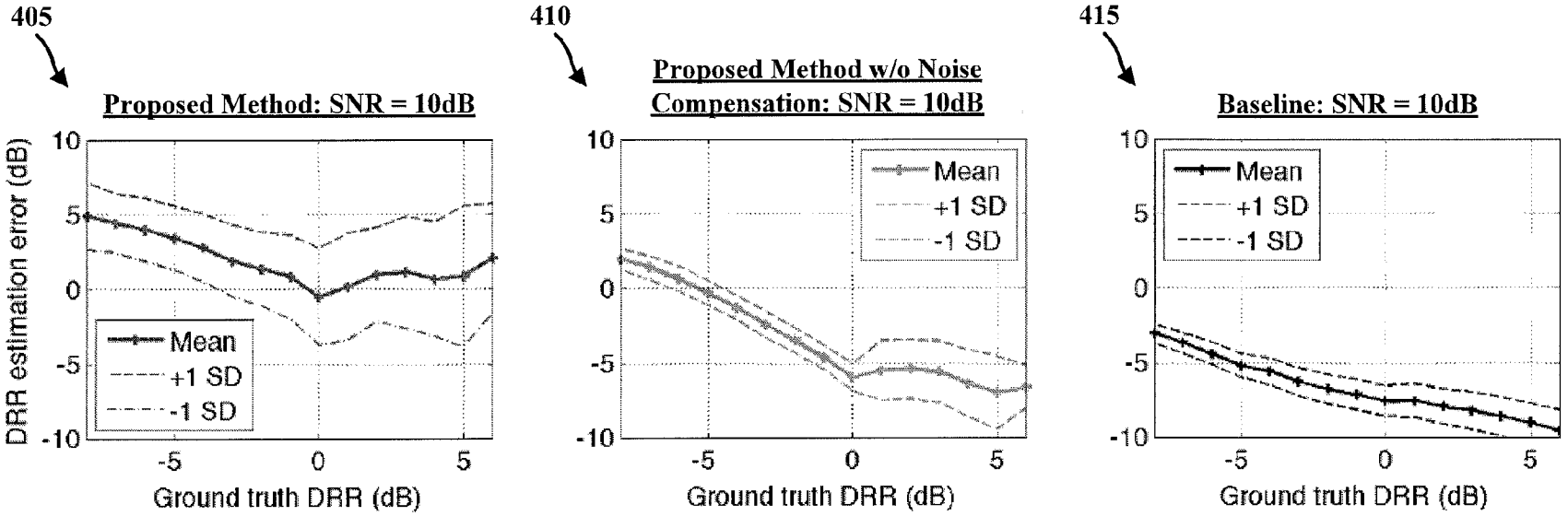
FIG. 4 is a set of graphical representations illustrating example performance results for a DRR estimation algorithm, a formulation of the DRR estimation algorithm without noise compensation, and a baseline algorithm at a Signal-to-Noise Ratio (SNR) of 10 dB according to one or more embodiments described herein.
Figure 5:
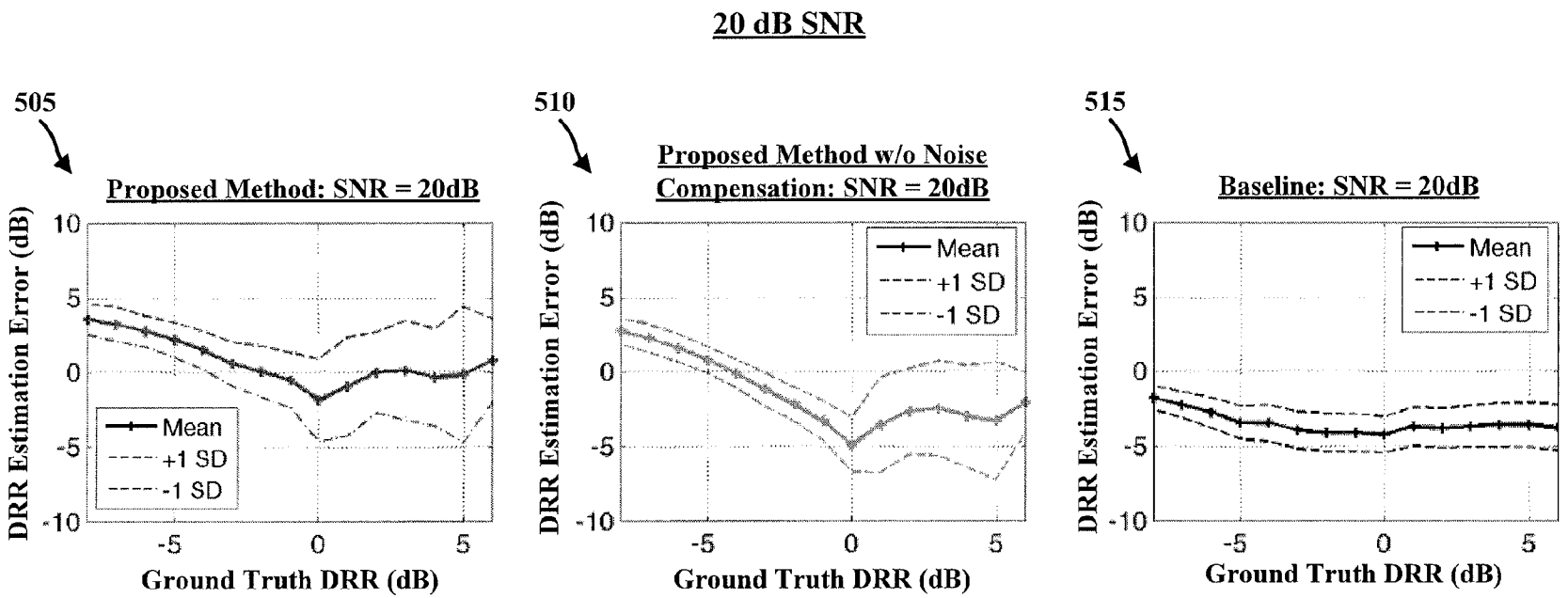
FIG. 5 is a set of graphical representations illustrating example performance results for a DRR estimation algorithm, a formulation of the DRR estimation algorithm without noise compensation, and a baseline algorithm at a SNR of 20 dB according to one or more embodiments described herein.
Figure 6:
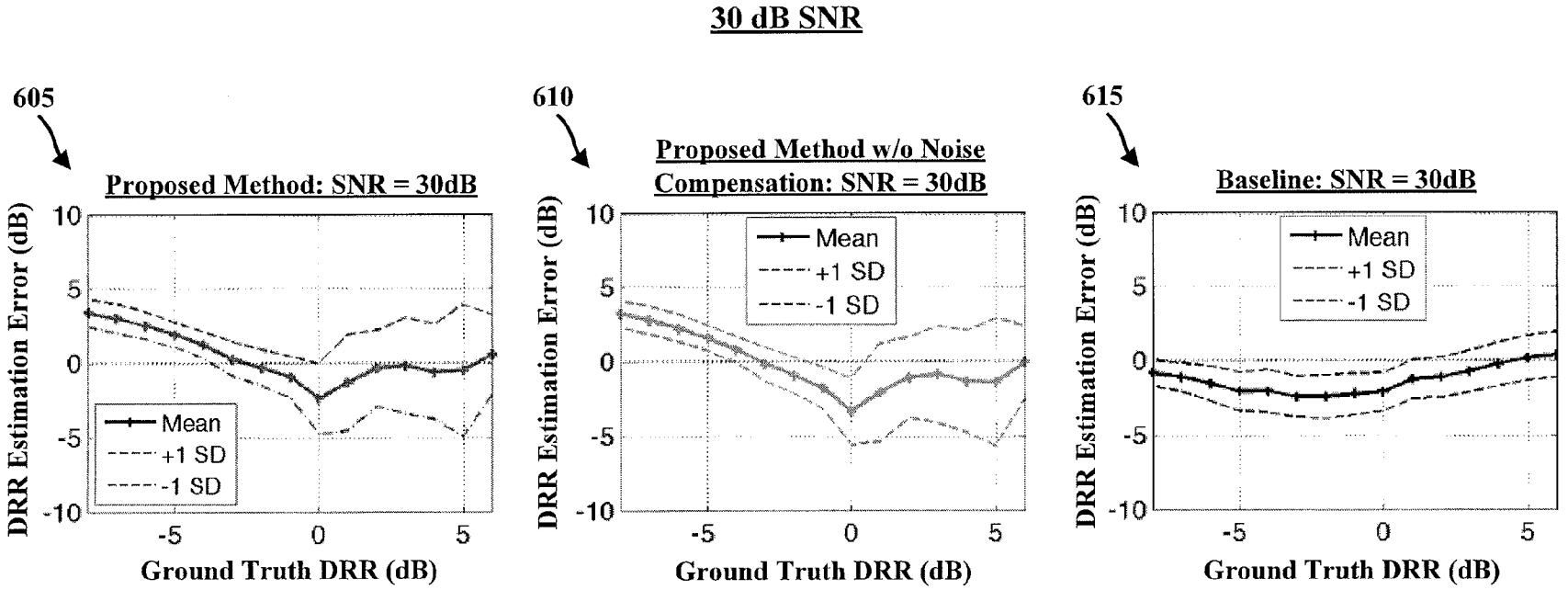
FIG. 6 is a set of graphical representations example performance results for a DRR estimation algorithm, a formulation of the DRR estimation algorithm without noise compensation, and a baseline algorithm at a SNR of 30 dB according to one or more embodiments described herein.

FIGS. 4-6 are graphical representations illustrating the DRR estimation accuracy of the algorithm described in accordance with embodiments of the present disclosure (405, 505, and 605), a formulation of the algorithm without considering noise (410, 510, and 610), and the baseline algorithm (415, 515, and 615) at SNRs of 10 dB, 20 dB, and 30 dB. As shown in graphical representations 405, 505, and 605, the algorithm of the present disclosure is accurate with less than 3 dB error across (ground truth) DRRs ranging from −5 to 5 dB. It should be noted that as DRR decreases, the method of the present disclosure may tend to overestimate DRR. This is a result of the assumption that reflections arrive from all angles with equal probability. For a particular room and $T_{60}$, lower DRRs are obtained with larger source microphone distances. This, in turn, results in the strong early reflections arriving from directions which are closer to the direct path DoA and are therefore more attenuated by the beamformer null. By under-accounting for these early reflections in equation (12), the DRR is overestimated.

The importance of including noise in the formulation of the algorithm of the present disclosure is evident by comparing the example accuracies of the algorithm with and without noise compensation (graphical representations 405, 505, and 605 for the algorithm with noise compensation and graphical representations 410, 510, and 610 for the algorithm without noise compensation) to the baseline algorithm (graphical representations 415, 515, and 615). Without noise compensation, the method of the present disclosure follows the tendency of the baseline algorithm to underestimate DRR as noise increases. Conversely, with noise included in the formulation, the accuracy of the method of the present disclosure is consistent across the range of SNRs shown (in graphical representations 405, 505, and 605), with only a slight increase in the standard deviation of the estimates.

Figure 7:
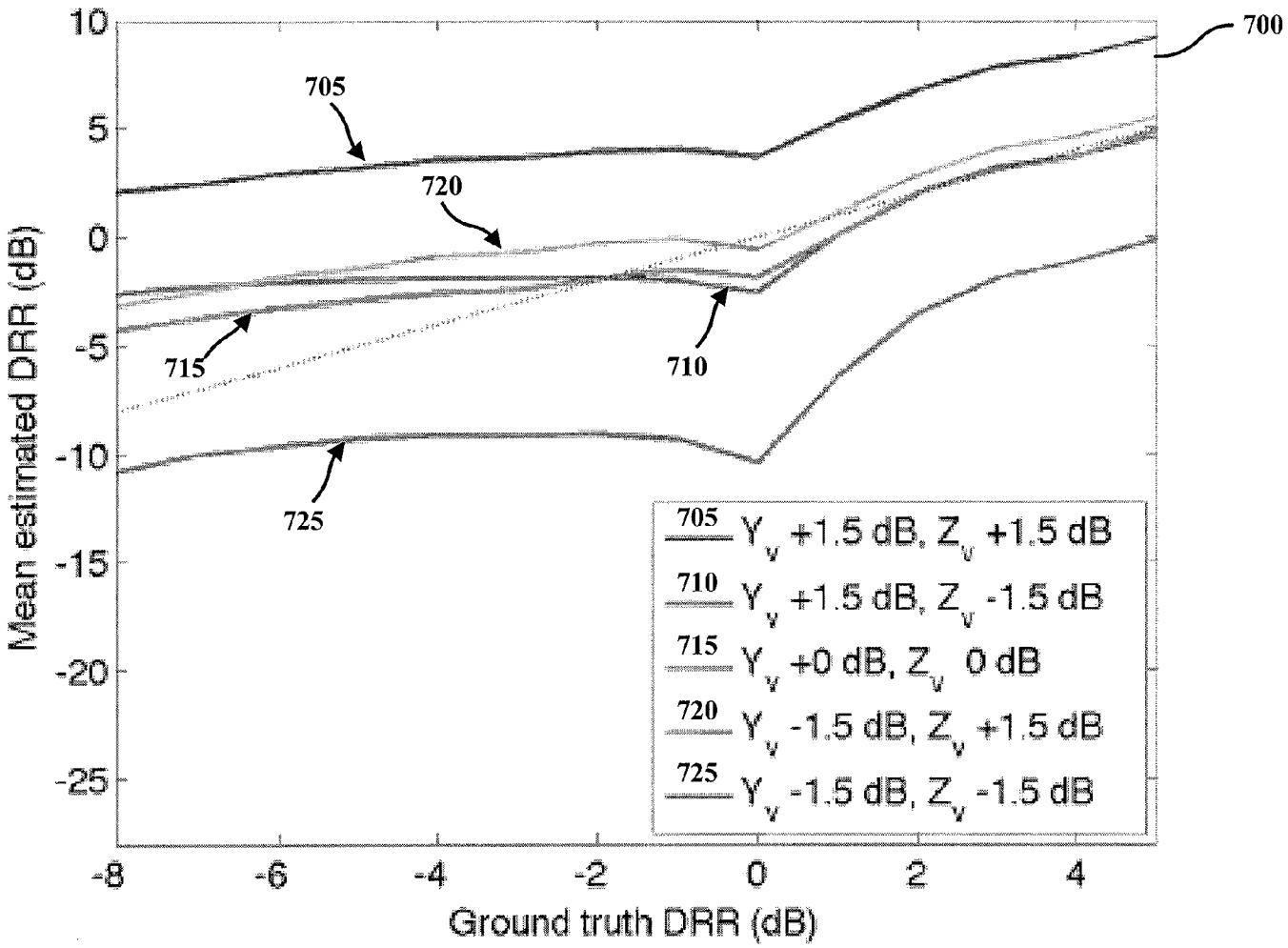
FIG. 7 is a graphical representation illustrating example effects of noise estimation errors on mean DRR estimates according to one or more embodiments described herein.

FIG. 7 illustrates example effects of noise estimation errors on mean DRR estimates. In particular, graphical representation 700 shows the sensitivity to errors in noise estimation at the reference microphone and at the output of the beamformer. Where there are errors of opposite polarity (curves 710 and 720) affecting the direct and beamformed power, the DRR estimates remain close to the case where there is no error (curve 715), effectively cancelling each other out. Where the errors are of the same polarity (curves 705 and 725), there is an additive effect with a ±1.5 dB error on each term leading to a ±3 dB error overall. This suggests that the method of the present disclosure is more sensitive to the bias in a noise estimator than its variance.

It should be noted that the methods and systems of the present disclosure are designed to achieve similar performance with numerous other configurations (e.g., positioning) of sources with respect to the microphone array, in addition to the example configuration described above. For example, DRR estimation algorithm described herein can be applied to a multi-channel system with an arbitrary number of microphones with the selection of an appropriate beamformer.

As is evident from the above descriptions, the methods and systems of the present disclosure provide a novel approach for estimating DRR from multi-channel speech taking noise into account. The example performance results described above confirm that the methods and systems of the present disclosure are more robust to noise than the baseline at realistic SNRs. The formulation described returns an estimate of DRR according to frequency, and therefore in accordance with one or more embodiments, a frequency dependent DRR could be provided if desired. In addition, since the methods and systems do not rely on the statistics of speech, in accordance with one or more other embodiments, the DRR estimation algorithm could also be applied to music.

Figure 8:
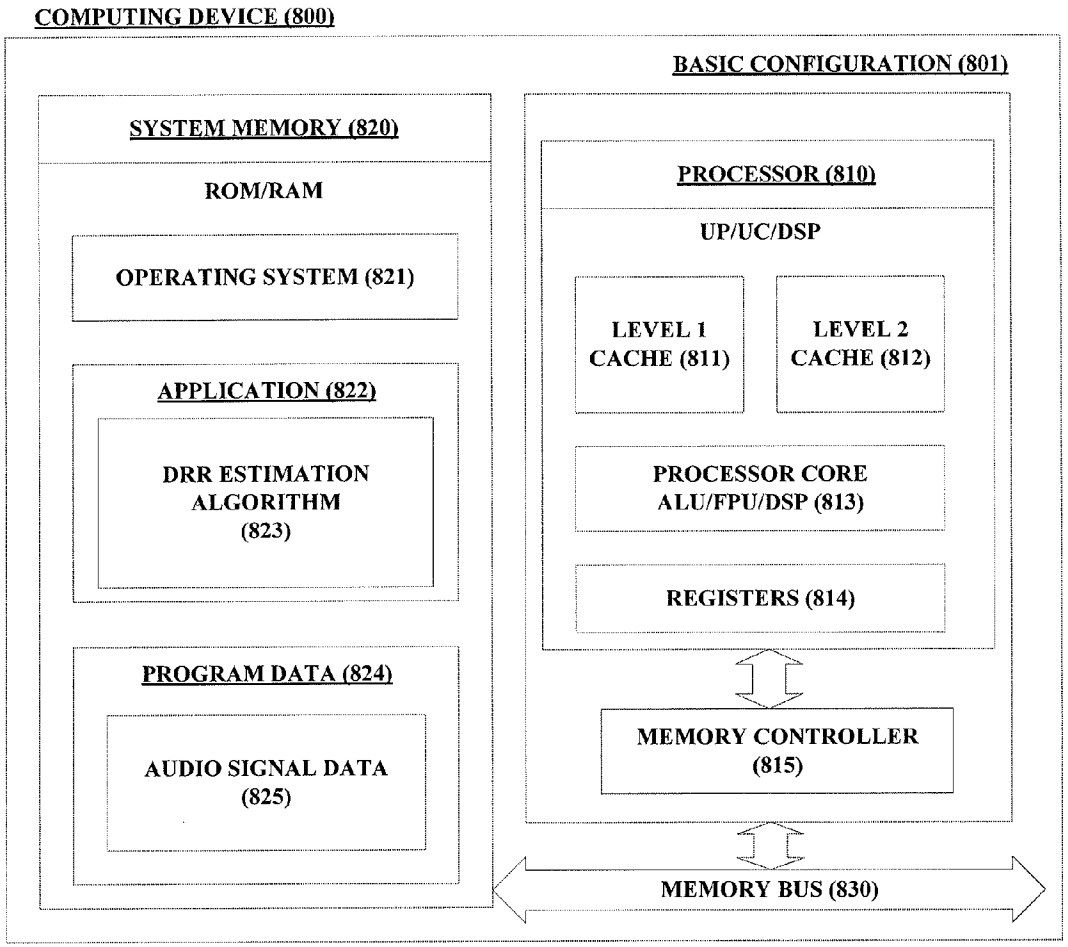
FIG. 8 is a block diagram illustrating an example computing device arranged for generating DRR estimates using a null-steered beamformer according to one or more embodiments described herein.

FIG. 8 is a high-level block diagram of an exemplary computer (800) arranged for generating DRR estimates using a null-steered beamformer, where the generated DRR estimates are accurate across a variety of room sizes, reverberation times, and source-receiver distances, according to one or more embodiments described herein. In accordance with at least one embodiment, the computer (800) may be configured to utilize spatial selectivity to separate direct and reverberant energy and account for noise separately, thereby considering the response of the beamformer to reverberant sound and the effect of noise. In a very basic configuration (801), the computing device (800) typically includes one or more processors (810) and system memory (820). A memory bus (830) can be used for communicating between the processor (810) and the system memory (820).

Depending on the desired configuration, the processor (810) can be of any type including but not limited to a microprocessor (μP), a microcontroller (μC), a digital signal processor (DSP), or any combination thereof. The processor (810) can include one more levels of caching, such as a level one cache (811) and a level two cache (812), a processor core (813), and registers (814). The processor core (813) can include an arithmetic logic unit (ALU), a floating point unit (FPU), a digital signal processing core (DSP Core), or any combination thereof. A memory controller (815) can also be used with the processor (810), or in some implementations the memory controller (815) can be an internal part of the processor (810).

Depending on the desired configuration, the system memory (820) can be of any type including but not limited to volatile memory (such as RAM), non-volatile memory (such as ROM, flash memory, etc.) or any combination thereof. System memory (820) typically includes an operating system (821), one or more applications (822), and program data (824). The application (822) may include DRR Estimation Algorithm (823) for generating DRR estimates using spatial selectivity to separate direct and reverberant energy and account for environmental noise separately, in accordance with one or more embodiments described herein. Program Data (824) may include storing instructions that, when executed by the one or more processing devices, implement a method for estimating DRR by using a null-steered beamformer, where the estimated DRR may be used to assess a corresponding acoustic configuration and may also be used to inform one or more de-reverberation algorithms, according to one or more embodiments described herein.

Additionally, in accordance with at least one embodiment, program data (824) may include audio signal data (825), which may include data about the locations of microphones within a room or area, the geometry of the room or area, as well as the reflectivity of various surfaces in the room or area (which together may constitute the AIR). In some embodiments, the application (822) can be arranged to operate with program data (824) on an operating system (821).

The computing device (800) can have additional features or functionality, and additional interfaces to facilitate communications between the basic configuration (801) and any required devices and interfaces.

System memory (820) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media can be part of the device (800).

The computing device (800) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (800) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of the present disclosure.

In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A computer-implemented method comprising:

receiving an audio signal in a system;

removing a direct path signal component of the audio signal by placing a beamformer null at a direction of the direct path signal component, thereby separating the direct path signal component from a reverberant path signal component of the audio signal;

determining, for each of a plurality of frequency bins, a ratio of the power of the direct path signal component to the power of the reverberant path signal component;

combining the determined ratios over a range of the frequency bins; and performing, using the combination of the determined ratios, speech enhancement signal processing on the audio signal and outputting an enhanced audio signal from the system.

2. The method of claim 1, wherein placing the beamformer null at the direction of the direct path signal component includes:

selecting weights for the beamformer to steer the null towards a direction of arrival of the direct path signal component.

3. The method of claim 2, wherein the weights for the beamformer are selected based on time difference of arrival estimation using an estimated time delay.

4. The method of claim 1, further comprising:

compensating for estimated noise received at the beamformer.

5. A system comprising:

a least one processor; and a non-transitory computer-readable medium coupled to the at least one processor having instructions stored thereon that, when executed by the at least one processor, causes the at least one processor to:

receive an audio signal;

remove a direct path signal component of the audio signal by placing a beamformer null at a direction of the direct path signal component, thereby separating the direct path signal component from a reverberant path signal component of the audio signal;

determine, for each of a plurality of frequency bins, a ratio of the power of the direct path signal component to the power of the reverberant path signal component;

combine the determined ratios over a range of the frequency bins; and perform, using the combination of the determined ratios, speech enhancement signal processing on the audio signal and outputting an enhanced audio signal from the system.

6. The system of claim 5, wherein the at least one processor is further caused to:

select weights for the beamformer to steer the null towards a direction of arrival of the direct path signal component.

7. The system of claim 6, wherein the weights for the beamformer are selected based on time difference of arrival estimation using an estimated time delay.

8. The system of claim 5, wherein the at least one processor is further caused to:

compensate for estimated noise received at the beamformer.

* * * * *